US007490369B2

(12) United States Patent
Cunningham

(10) Patent No.: US 7,490,369 B2
(45) Date of Patent: Feb. 17, 2009

(54) ILLUMINATED BATHTUB AND SUPPORT SYSTEM

(75) Inventor: Jeffrey L. Cunningham, Cabot, AR (US)

(73) Assignee: Jason International, Inc., North Little Rock, AR (US)

( * ) Notice: Subject to any disclaimer, the term of this patent is extended or adjusted under 35 U.S.C. 154(b) by 0 days.

(21) Appl. No.: 11/740,086

(22) Filed: Apr. 25, 2007

(65) Prior Publication Data

US 2008/0222788 A1 Sep. 18, 2008

Related U.S. Application Data

(63) Continuation-in-part of application No. 29/278,034, filed on Mar. 16, 2007, now Pat. No. Des. 566,247.

(51) Int. Cl.
*A46H 33/02* (2006.01)

(52) U.S. Cl. ..... 4/545; 4/538

(58) Field of Classification Search ..... 4/492, 4/538, 546, 549, 584, 592–593, 595, 645, 4/696, 559

See application file for complete search history.

(56) References Cited

U.S. PATENT DOCUMENTS

| | | | | | |
|---|---|---|---|---|---|
| 2,528,432 | A * | 10/1950 | Heckathorn | 4/595 |
| 4,535,489 | A * | 8/1985 | Elkins | 4/546 |
| 4,875,958 | A * | 10/1989 | Kurokawa | 156/108 |
| 6,269,494 | B1 * | 8/2001 | Moretto | 4/584 |
| 6,360,380 | B1 * | 3/2002 | Swart et al. | 4/541.1 |
| 6,539,561 | B2 * | 4/2003 | Shimizu | 4/559 |
| 6,752,517 | B2 * | 6/2004 | Hildebrand et al. | 362/231 |

* cited by examiner

*Primary Examiner*—Huyen Le
(74) *Attorney, Agent, or Firm*—Banner & Witcoff, Ltd.

(57) ABSTRACT

A bathtub has a shell for transmitting light thorough a thickness. A light emitting diode is disposed under the shell, in which the light from the light emitting diode is transmitted thorough the thickness of the shell. A bathtub includes a reflector sheet for reflecting light from the light emitting diode. The light emitting diode may be disposed between the reflector sheet and the shell. A bathtub includes a light diffuser panel disposed between the shell and the light emitting diode. A bathtub includes a support panel disposed between the shell and the light emitting diode.

20 Claims, 7 Drawing Sheets

ILLUMINATED BATHTUB AND SUPPORT SYSTEM

CROSS-REFERENCE TO RELATED APPLICATIONS

This application is continuation-in part of U.S. patent application Ser. No. 29/278,034 filed on Mar. 16, 2007 and the contents are incorporated by reference herein.

FIELD OF THE INVENTION

The present invention pertains to a bathtub, in particular a chromatherapy bathtub system.

BACKGROUND OF THE INVENTION

Most conventional freestanding baths today are manufactured out of opaque acrylic, reinforced with FRP (fiberglass reinforced plastic consisting typically of resin, fiberglass, fillers and catalyst) or similar reinforcing backing which is then placed into another acrylic skirt designed to hide the reinforcing backing. The skirts may be an integral part of the bath vessel or they may be separate and attached to the bath vessel allowing for a space between the vessel and the bath skirt for plumbing or equipment. There have been some attempts to produce a freestanding bath with opaque, translucent or semi translucent acrylic as an alternative to this but there design and support structure needed improvements and they ultimately have not sold well in the market. As of today there is no current manufacturer of translucent or semi translucent acrylic freestanding baths in the market.

Conventional freestanding baths that require FRP reinforcement are difficult to manufacture and less environmentally friendly due to the additional labor and material required to reinforce the acrylic shells and the volatile organic compounds (VOCs) released into the atmosphere during the FRP process.

Current freestanding baths are not easily leveled once installed. Typically, the baths need to be shimmed, if the floor is not level. This process can be difficult and additional shim block detracts from the overall appearance. Further, the leveling systems are not easy to use and are aesthetically unacceptable to a portion of the population. Current freestanding baths are difficult to properly secure to the floor to avoid unwanted moving of the bath once installed.

The current free standing baths do not provide lighting for the well of the bath. Alternatively, if a through-wall light is provided, it is difficult to access and is aesthetically unacceptable to some end-users of conventional bathtubs.

In another deficiency, current freestanding baths do not adequately support the acrylic shell. The bath shell may have undesirable high stresses around the drain area of the acrylic bath shell, low resistance to point impact loads, loads on the rim and bottom and loads on unsupported bath tub areas.

In view of the foregoing, there is a need for an improved freestanding bath to overcome problems in the art as an alternate to the existing freestanding baths in the market today. There is also a need to provide a unique way to illuminate the bath shell and the water in the well.

BRIEF SUMMARY OF THE INVENTION

The present invention pertains to a bathtub system with various features which overcomes the various problems in art.

In one aspect, a bathtub comprises a shell for transmitting light thorough a thickness. A light emitting diode is disposed under the shell, in which the light from the light emitting diode is transmitted thorough the thickness of the shell.

In yet another aspect, a bathtub may include a reflector sheet for reflecting light from the light emitting diode. The light emitting diode may be disposed between the reflector sheet and the shell. In another aspect, a bathtub may include a light diffuser panel disposed between the shell and the light emitting diode. In yet another aspect, a bathtub may include a support panel disposed between the shell and the light emitting diode. In a further aspect, a bathtub may include a support panel provided between the light diffuser panel and the light emitting diode.

In another aspect, a support frame includes with a resilient member provided between the shell and the support frame. In one aspect, a cover panel provided below the shell and surrounding the light emitting diode. In one aspect, a support frame is provided for holding the shell and the support frame includes a shaft movable in the leveling extension of the cover panel. In one aspect, shell includes a rim channel and the support frame includes a top tube configured to be received in the rim channel.

In one aspect, a bathtub includes a shell, a support for retaining the shell, and a cover panel operably connected to the support for vertically moving the shell. In another aspect, the cover panel includes a level adjuster extending therefrom and the support includes a threaded device for receiving in the level adjuster. In yet another aspect, the shell comprises a light transmissible material so that the light from light emitting diodes is transmitted via the shell. In another aspect, a bathtub has an easy leveling system that can be hidden from view during normal use for improving appearance of the bathtub.

BRIEF DESCRIPTION OF THE DRAWINGS

The foregoing summary of the invention, as well as the following detailed description of illustrative embodiments, is better understood when read in conjunction with the accompanying drawings, which are included by way of example, and not by way of limitation with regard to the claimed invention.

DETAILED DESCRIPTION OF THE INVENTION

Figure 1:
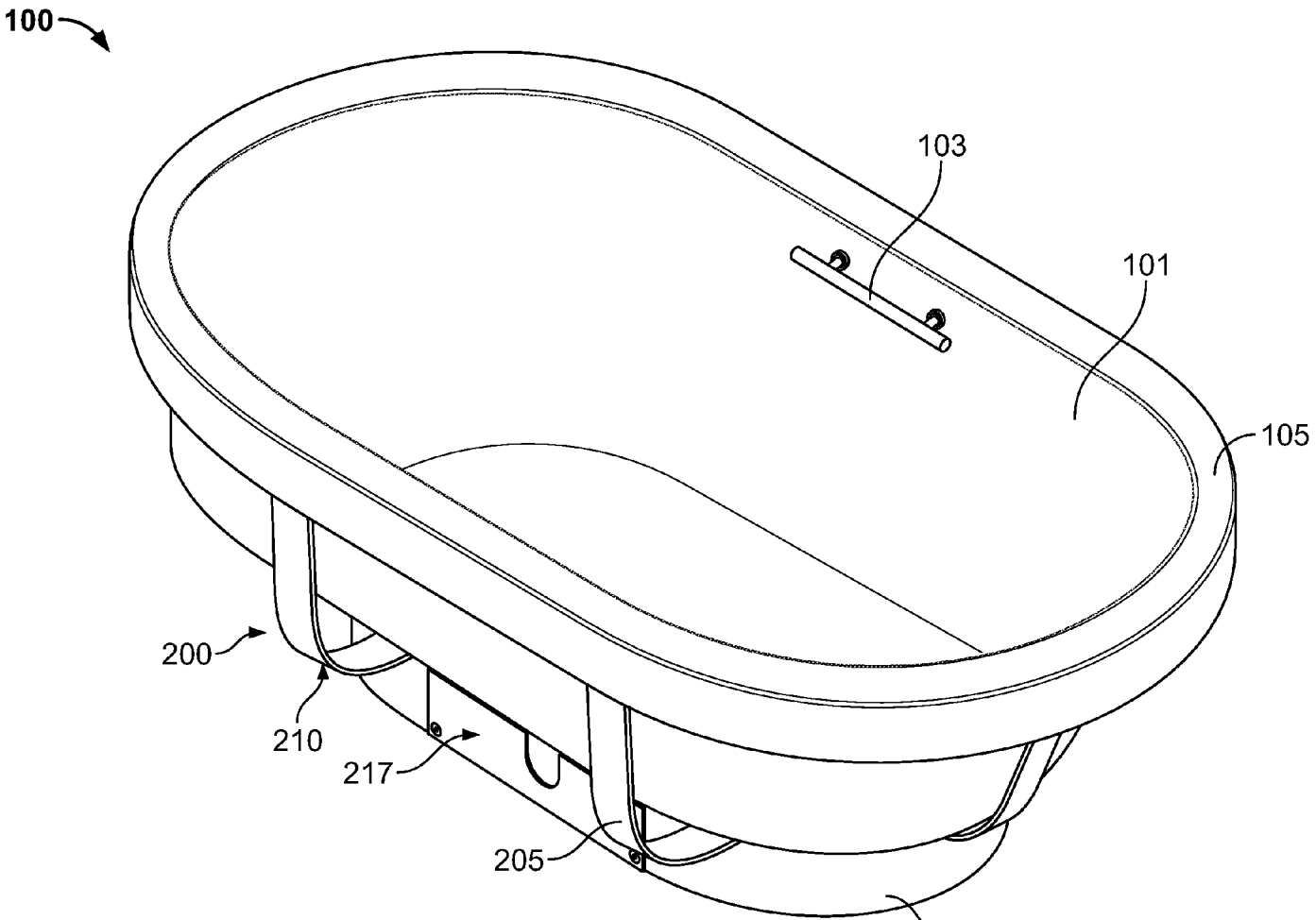
FIG. 1 is a perspective view of a bathtub assembly according to one construction.

FIG. 1 illustrates a bathtub system 100 according to a construction or embodiment of the invention(s) disclosed. Bathtub system 100 generally comprises a bath shell 101 for retaining water and an end-user in the well and a support structure 200 for supporting the weight of the bath shell 101 and other components of the bathtub system 200. While the bath shell 101 is shown in a "soaker" or "soaking" configuration, the shell 101 could be for a whirlpool system, air bath system or combination of both in alternative constructions. It is understood that other embodiments may be utilized and structural and functional modifications may be made without departing from the scope of the present invention.

Figure 2:
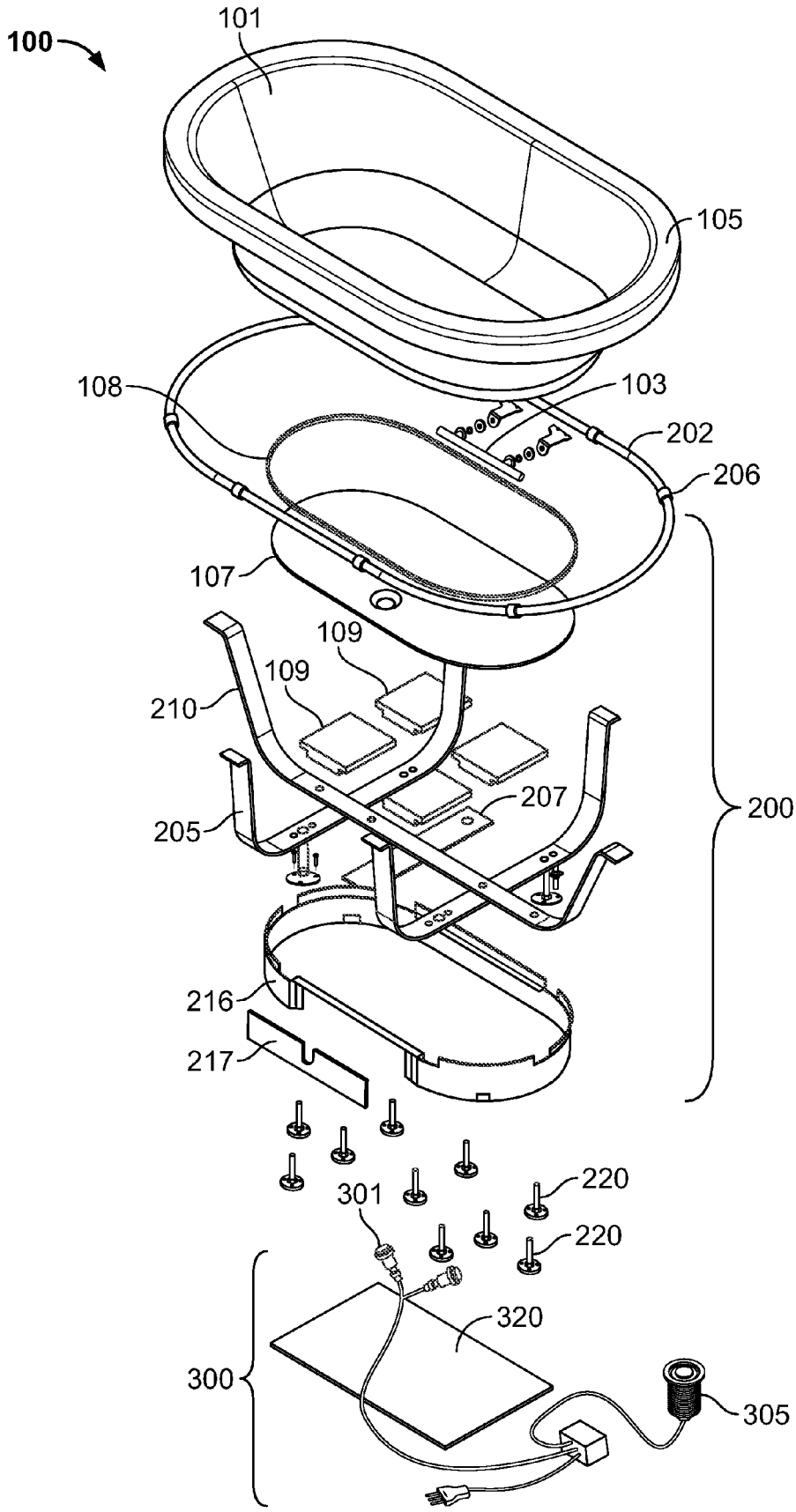
FIG. 2 is an exploded assembly view of a bathtub system according to one construction.

In yet another construction shown in FIG. 2, the bathtub system 100 may include a semi transparent shell 101 formed of an acrylic material and a lighting system 300 configured to illuminate the bottom of the semi transparent acrylic bath shell 101 and the water in the interior well of the shell 101 via transmission of light through the shell material. As will be discussed in the foregoing, the lighting system 300 may include a variety of light sources to produce the desired lighting for chromatherapy of the end-user. In one construction, the light source is in the form of Light Emitting Diodes (LEDs).

Figure 3:
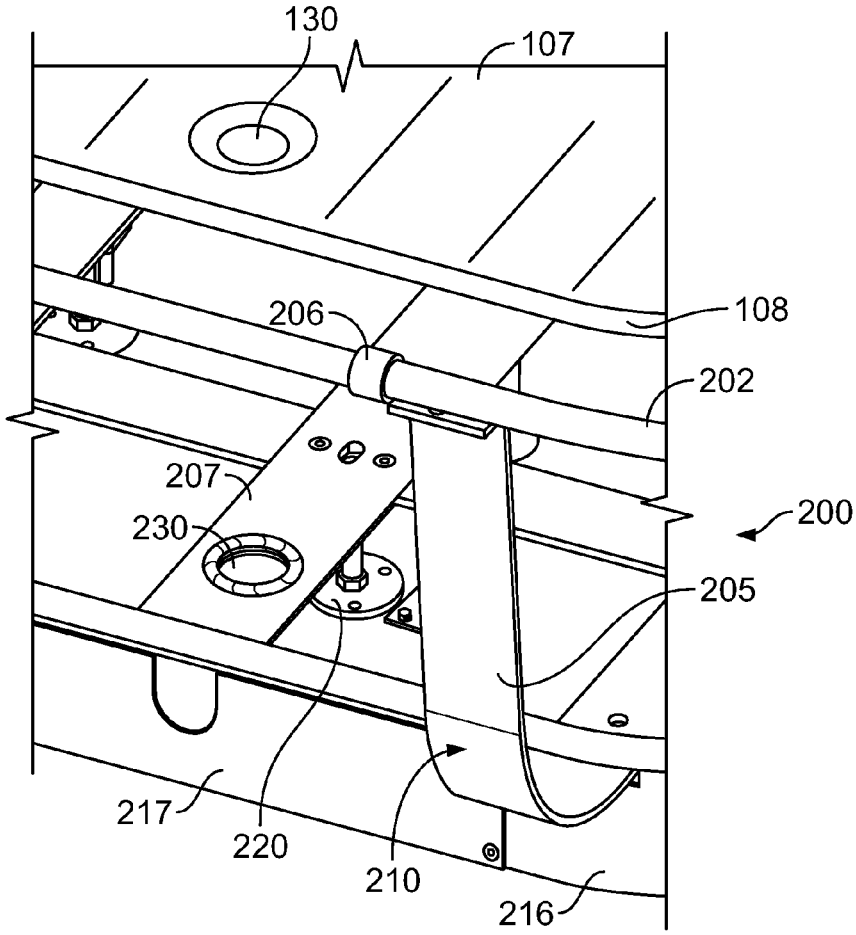
FIG. 3 is an enlarged view of a support structure assembly according to one construction.
Figure 4:
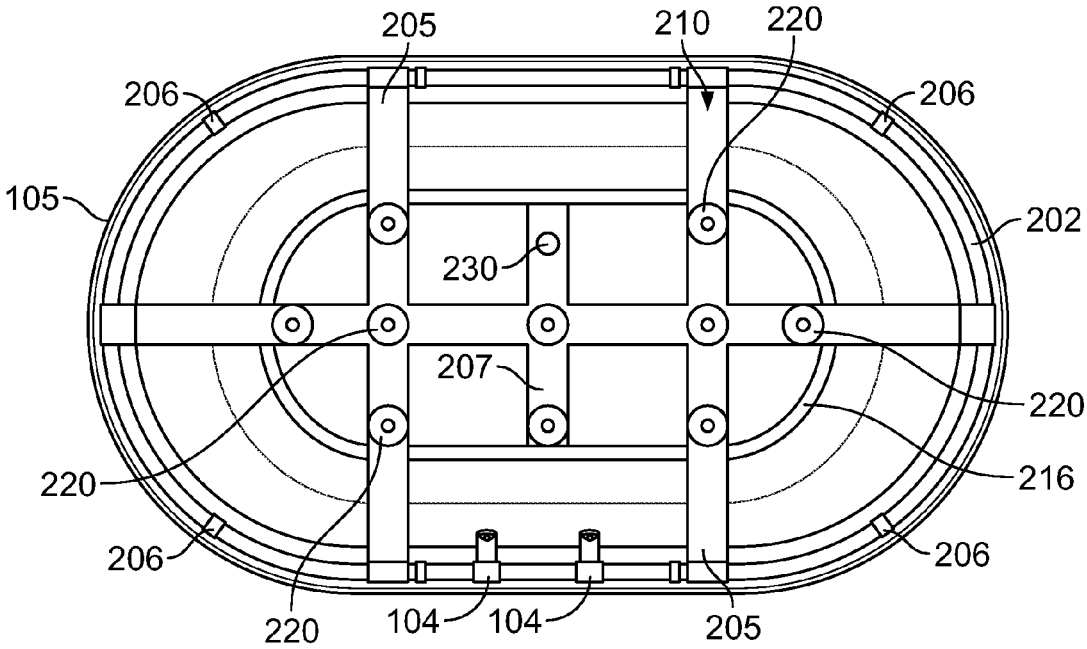
FIG. 4 is a bottom plan view of the bathtub shell on a support structure with the bottom of the support structure with leveling elements.

Referring to FIGS. 2, 3, and 4, the support structure 200 includes an oval-shaped tube assembly 202 configured to abut the underside of the top rim 105 of the bath shell 101. In this construction, bath shell 101 rests on the tub assembly 202 so that shell 101 is reliably supported at the top rim 105. With reference to FIGS. 3, and 4, a construction of the tube assembly 202 incorporates multiple bumper elements 206 for cushioning the abutment interface between the acrylic bath shell 101 and the oval tube assembly 202. There are a wide variety of materials that can be used for the bumpers 206. In one example, the bumper 206 may be of a resilient plastic material. The bumper 206 can be of a number of shapes, including cylindrical (tubular), prismatic and other shapes. Nevertheless, other shapes of the tube assembly 202 are possible as the tube is shaped to accommodate the bath shell 101. The support structure 200 of the bathtub system 100 includes a support frame 210 connected to the tube assembly 202. The incorporation of the bumper elements also eliminates the undesirable rubbing noise between the bath shell 101 and the support frame 210 when the bath is in use.

In one construction, the support frame assembly 210 is preassembled and is designed to provide a support cradle for the acrylic bath shell 101. The support frame 210 includes upright members 205 connected to the tube assembly 202. The support frame 210 may rest on a portion of cover panel 216 which is mounted to the floor. The interior of the cover panel 216 may be provided with a reflective surface to work in cooperation with light system 300 to illuminate the underside of the bath shell 101.

Figure 9:
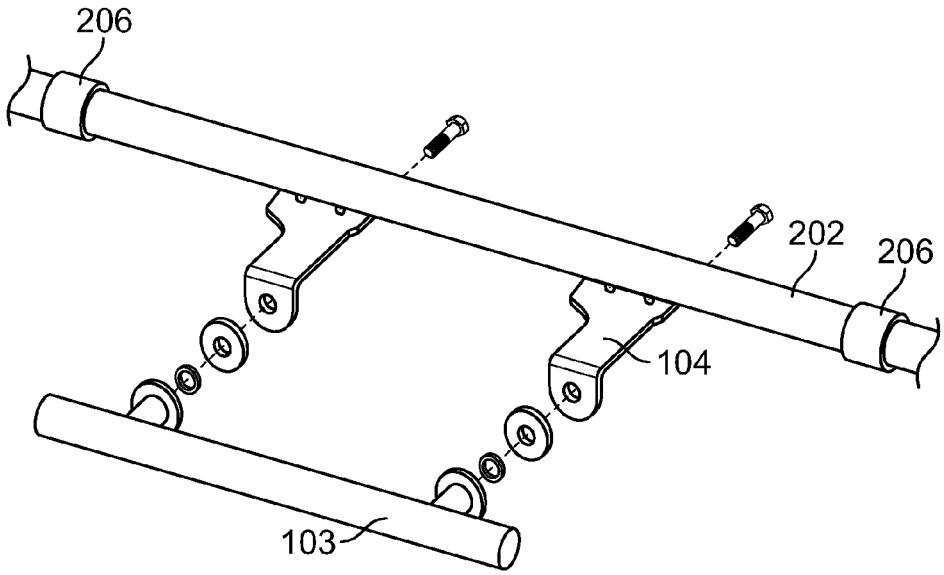
FIG. 9 is an assembly view of a grip system for a bathtub system according to one construction.

Referring to FIGS. 2 and 4, the bathtub system 100 can include a grip system with a grip handle 103, a grip handle bracket 104, and the associated grip handle hardware, such as a grommet, washer, and bolt. The combination of the handle and bracket (e.g., grip system) provides a structure for a person to hold as an aid in entering and exiting the bath shell 101. In a further construction, the grip system enables reliable attachment of the tube assembly 202 to the bath shell 101. This attachment feature can be seen in FIG. 4, in which elements of the grip system are mounted to the tube assembly 202 via brackets 104. The handle bracket 104 extends through apertures through in the sidewall of the bath shell 101 into the interior well of the shell 101. The handle 103 is attached to the handle bracket 104 by the desired hardware. (See FIG. 9). In addition to or alternatively, the bath shell 101 can also be attached to the support structure 200 by an exposed overflow drain, which is not shown.

The bath shell 101 may be configured to use most typical exposed overflow drains available. The attachment points can be at the overflow drain hole predrilled through the sidewall of the bath shell 101 and at the bottom drain hole predrilled or other provided through the bottom of the bath shell 101. The overflow is attached to the shell 101 by attaching the decorative cover to the overflow pipe with mechanical fasteners through the acrylic bath shell 101 hole and the drain is attached by inserting the male threaded decorative portion through the acrylic bath shell 101, plastic diffuser panel 107, and support frame assembly 200 into the female threaded drain elbow. Nevertheless, other constructions are possible.

Referring to FIGS. 2 and 3, bathtub system 100 may include a bumper element in the form of a bottom diffuser panel 107 surrounded by panel gasket 108. The bottom diffuser panel 107 is provided in an abutment arrangement directly under the bottom of the acrylic bath shell 101. This feature advantageously provides for distribution of the weight of the acrylic bath shell 101 into the support frame assembly 210. Because the bath shell 101 can be a translucent material construction, the panel 107 obscures support frame assembly 210 (underneath the shell 101), from view (when looking into downward into the well) and assists in diffusing the light transmitted from the lighting system 300. The diffuser panel 107 can be provided with a wide variety of constructions, including plastic material. Suitable plastic materials can be polypropylene or polyethylene, for example. An aperture 130 is provided in the diffuser panel 107 for placement of the drain. Panel gasket 108 provides for a snug-fit of the bath shell 101 and a shock absorption support structure 200. The gasket 108 can be an extruded construction or other configuration. Advantageously, the use of bumper elements between the support frame 210 and the underside of the bath shell 101 eliminates excessive wear between the support frame and the bath shell. It is noted that a drain hole 230 is provided in horizontal support member 207 to receive the drain for the bath shell 101.

Figure 5:
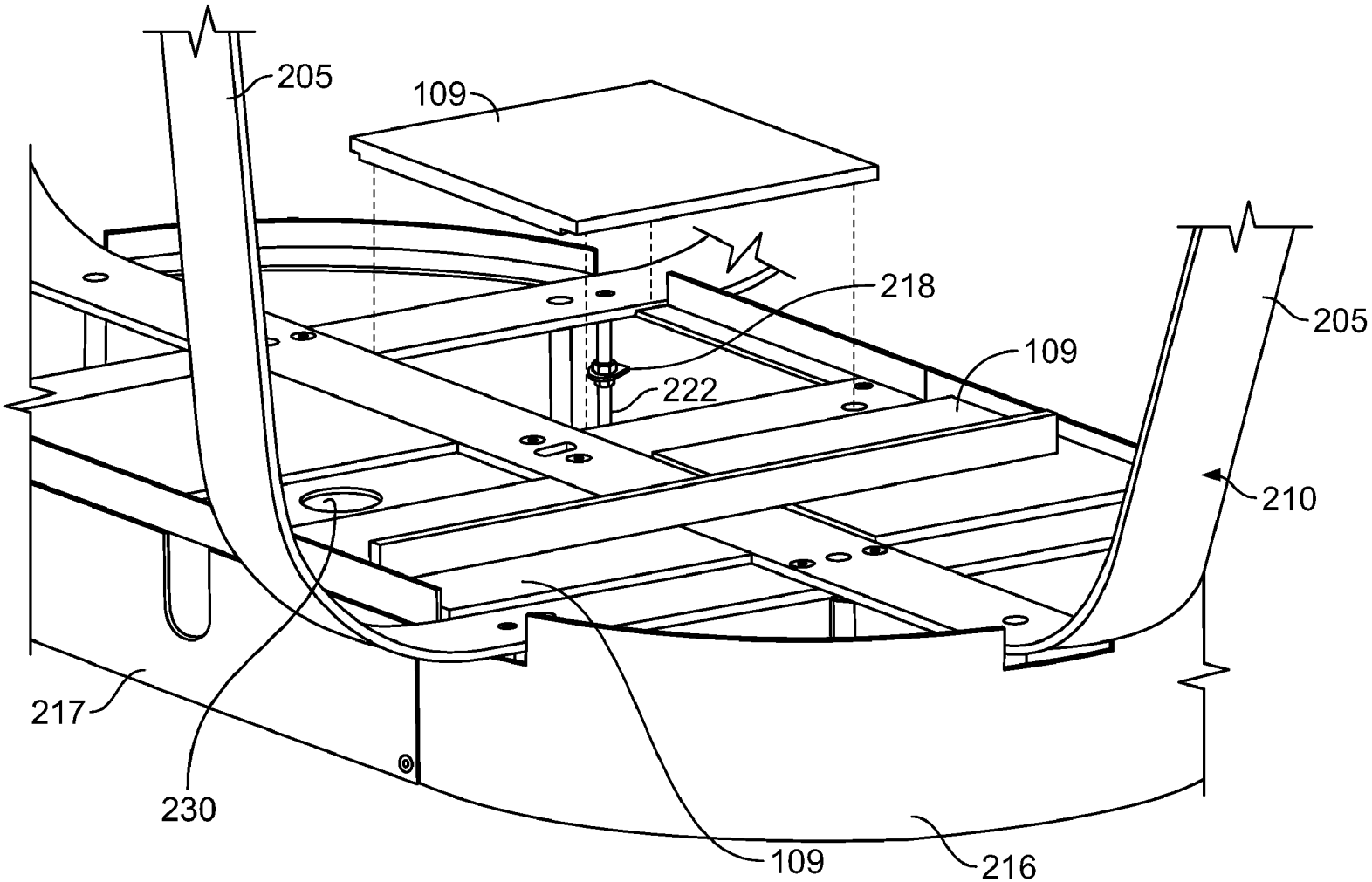
FIG. 5 is an enlarged view of a support structure assembly according to one construction.

With reference to FIGS. 2 and 5, bottom support panels 109 are disposed between the bottom supports members of the support frame assembly 210. The support panels 109 may be composed of a variety of materials, such as a semi-translucent acrylic material. While four bottom support panels 109 are shown in FIG. 2, more or less panels 109 can be used with the bathtub system 100. The support panels 109 provide additional structure load bearing support for the acrylic bath shell 101, while allowing the light from the lighting system 300 to illuminate the bottom of the acrylic bath shell 101 and the water in the well via the transmission of the light through the bath shell 101. In this way, the support panels 109 provide a dual function of weight bearing and serving as a light transmission device. These features make for efficient use of material and construction of the bathtub system 100.

Figure 6:
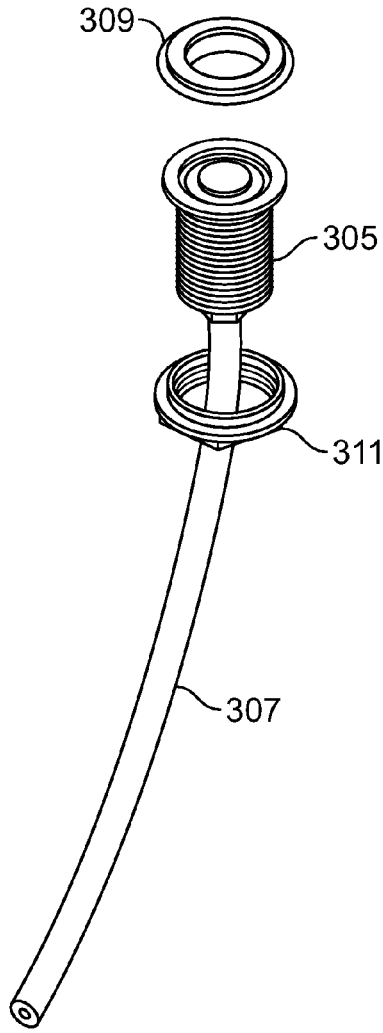
FIG. 6 is a partial exploded assembly view of a lighting system control according to one construction.
Figure 7:
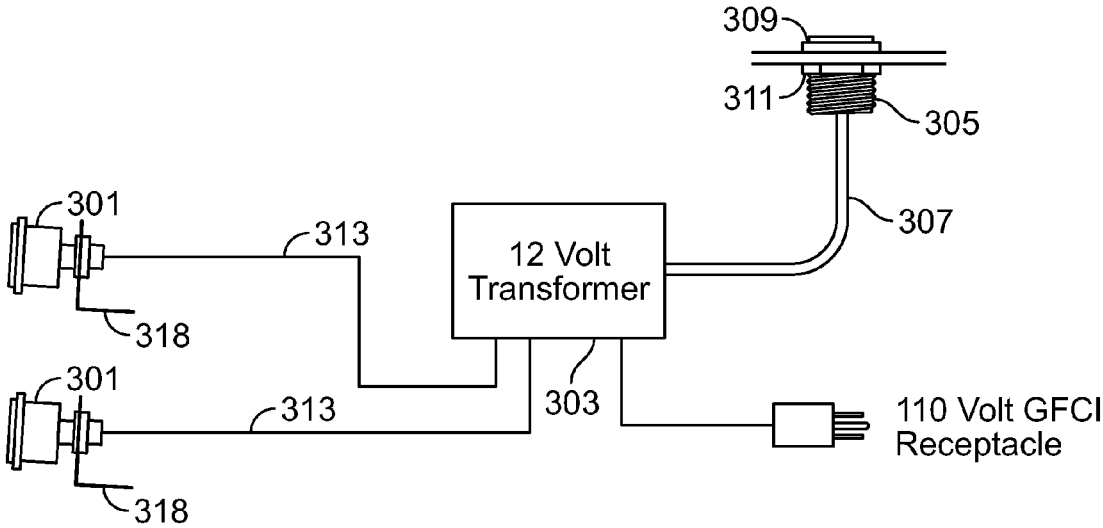
FIG. 7 is a schematic block diagram of lighting system according to one construction.

Referring to FIGS. 2, 6, 7 and 8, light system 300 is provided underneath the bath shell 101 and/or the support structure 200 for enabling chromatherapy of the end-user. The lighting system 300 may include one or more light housing units 301. In one construction, the light housing unit 301 may include a plurality of individual LED bulbs. The number of LED bulbs can be up to 50, but other values are possible in which the quantity may depend on the light output of the LEDs and desired intensity. The LED bulbs provide for an environmental friendly construction which reduces energy consumption and operating costs of the bathtub system 100. In a further advantage, the LED bulbs provide a relatively long operating life verses incandescent bulbs. Referring to FIG. 7, the light housing units 301 are electrically connected a transformer system 303 via wiring 313. In one case, the transformer system 303 is a step-down type so that 110 volts and stepped-down to 12 volts. The end-user has the ability to electrically control the LED light color choices to change the acrylic shell bottom 101 and the water in the well to their desired color preference and different sequences. In one construction, the housing units 301 include a microprocessor configured to control the sequences of the actuation of LEDs in the housing. The microprocessor can provide various controls to individual LEDs or groups of LEDs. The microprocessor may have a system memory with computer readable code in the form of read only memory (ROM) and random access memory (RAM). The memory stores programmable instructions of the operational logic sequences of the LEDs that are executed by microprocessor.

Turning to FIGS. 6 and 7, an air transmitter 305 enables control of the transformer system 303 for controlling the light housing units 301. The air transmitter 305 is in air communication with a tube 307 which transmits slightly pressurized air to the transformer system 303. The air transmitter 305 advantageously provides a safe and convenient method of controlling the light housing units 301. The end-user can press and release the transmitter 305 to turn on, off and scroll through various per-programmed light sequences of the housing units 301. The air transmitter 305 is mounted at a desired location proximate to the bath shell 101 to enable the end-user to actuate lighting system 300. The air transmitter 305 is mounted to a surface via trim 309 and nut assembly 311. Nevertheless, other constructions and mounted arrangements are possible.

Figure 10:
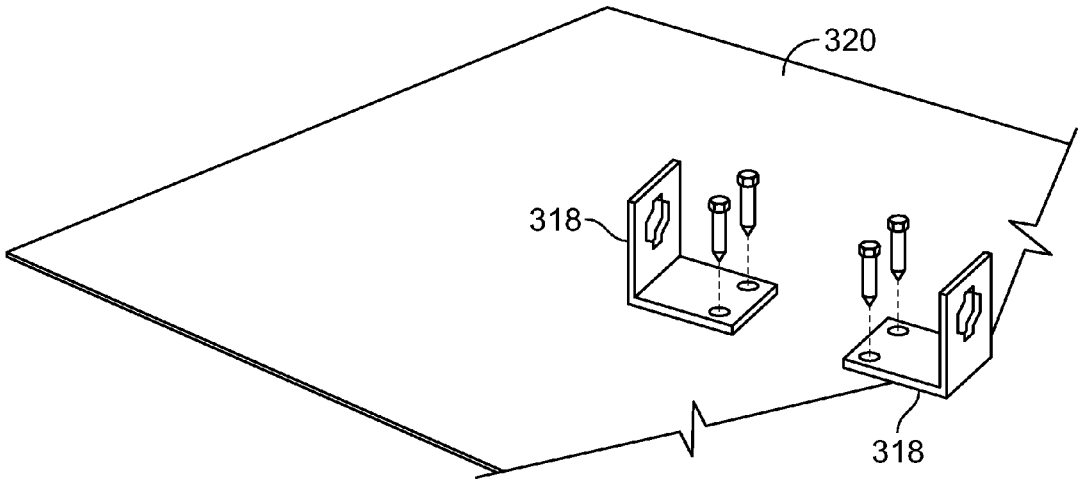
FIG. 10 is an enlarged view of a lighting construction.

Referring to FIG. 7, in one construction, the LED lights housing units 301 are positioned in the center of the LED light reflector 320, and the bottom of the acrylic bath shell 101. The light reflector 320 is generally centered underneath the bath shell 101 and located on the floor surface. The LED light reflector 320 can be made of a number of materials, such as a Mylar rectangular sheet of reflective material. In one construction, the light housing units 301 are mounted into a receiver in L-shaped light brackets 318. (See FIG. 10). The receiver retains the housing units 301 via a twist-lock arrangement. Of course, other fastening constructions and constructions of the light brackets 318 are possible. The brackets 318 are attached to the floor and the LED light reflector 320 with the desired fastening hardware, such as screws and the like.

The reflective surface of the interior of the cover panel assembly 216 provides lighting benefits. In operation of the bathtub system 100, the light illumination from the light housing units 301 is directed generally parallel with respect to the LED light reflector 320 and the bottom of the acrylic bath shell 101. This arrangement enables the transmitted light to reflect inside the cover panel assembly 216, off the LED light reflector 320, and be transmitted through the bottom of the acrylic bath shell 101. The light housing units 301 can be opposed to each other to provide more uniform illumination to the bath shell 101. In a further construction, the housing units 301 can be aligned with each other.

Hence, the bathtub system 100 improves the lighting of the bath shell 101 well by providing the illumination from the underside bottom of the bath shell 101. This feature eliminates the need to drill a hole through the shell sidewall for the installation of the light and provides an easy and efficient method to access the light units 301 after installation.

Figure 8:
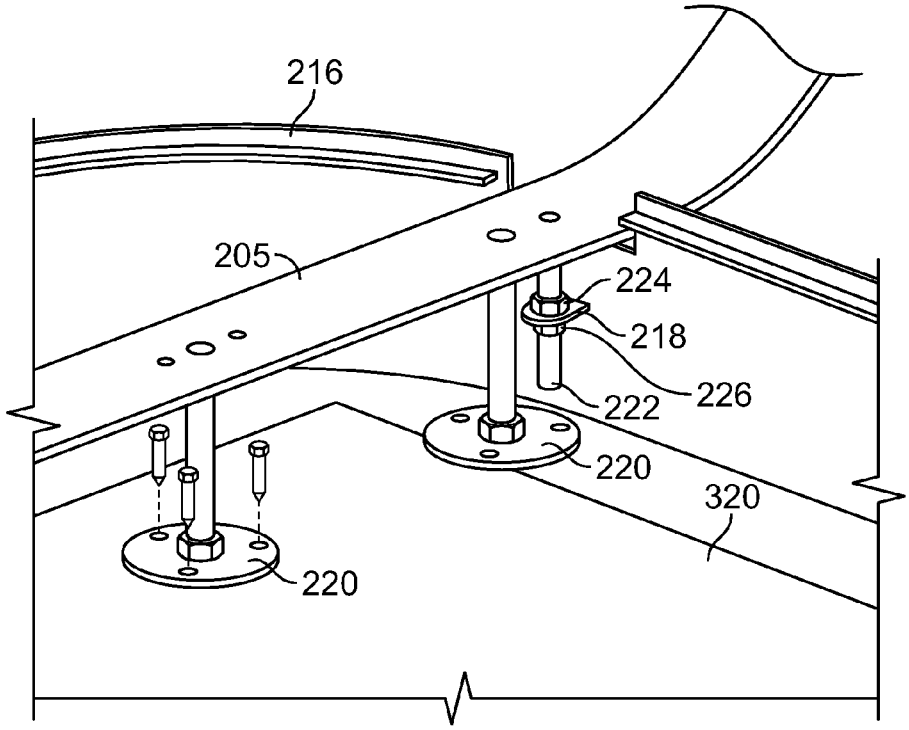
FIG. 8 is an enlarged view of a support structure assembly according to one construction.

Referring to FIGS. 4 and 8, the bathtub system 100 provides an advantageous structure and method for leveling the bath shell 101 in the installed configuration. The acrylic bath shell 101 and support frame assembly 210 are leveled with the leveling feet 220 and level adjusters 222. When viewing FIG. 8, the interior surface of the cover assembly 216 includes inwardly extending tabs 218 that receives level adjusters 222, such as threaded shaft. The level adjusters 220 connected to the underside of the upright members 205 and horizontal support member 207. It is noted that the cover panel assembly 216 is mounted the floor via bolts or screws. To level the bath shell 101 and support frame assembly 210, an adjustment bolt 224 is turned clockwise or counter-clockwise to move the upright members 205 in a direction generally perpendicular to the floor surface (e.g., up or down in a vertical direction). After the bath shell 101 is at the desired level, a locknut 226 is engaged on the level adjuster 222 to retain the desired height adjustment.

As can be seen in FIGS. 2 and 5, a pathway to provide access to the level adjusters and the leveling feet is provided through the access panel 217, and associated hardware during and after installation. The other parts of the support structure 200 and the LED lighting system 300 are also hidden by the cover panel assembly 217. Hence, one construction of the bathtub system 100 provides a way secured the system 100 to the floor and enable easy of access underneath the bath shell 101. Also, unsightly wiring is hidden from view during normal use of the bathtub system 100.

In one construction, because the bath shell 101 does not require additional reinforcement, the problems in art were eliminated. In a preferred construction, the shell 101 does not require additional reinforcing as a conventional bath shells. A typical acrylic shell that is reinforced with FRP is 0.100 inches to 0.187 inches. The non-reinforced semi translucent acrylic shell in one embodiment can be 0.314 inches to 0.393 inches thick. Hence, the non-reinforced shell is about three times thicker than that of a conventional bath.

Aspects of the bathtub system 100 construction provide for a reliable support and safe product. In one construction, bathtub system 100 has improved overall structural performance pertaining to the stacking configuration of the acrylic shell 101 on a bottom diffuser panel 107 and support frame assembly 210. A drain extending through the components in the stacked configuration provides improved load support performance over conventional bathtubs and quasi-governmental standards, such as ANSI Z124.1.2-2005. In another construction of bathtub system 100, point impact load performance over conventional bath can be attributed to a number of factors, such as a thicker bath shell 101, the stacking of the acrylic panels 109 with the diffuser panel 107, and the support of the frame assembly 210. Of course, other configurations for the point impact load performance are possible.

In yet another construction of bathtub system 100, the load support performance on the rim and bottom of the bath shell 101 and in the unsupported bathtub areas are improved over conventional bathtubs. This improved performance can be attributed to a number of factors, such as the increased thickness of shell, the stacking features of the panel 109, bottom diffuser panel 107, support frame assembly 210 and the leveling feet. In operation, the previously described features, individually and/or in any combination, improves support and lighting characteristics of a bathtub system. While the various features of bathtub system 100 operate together to achieve the advantages previously described, it is recognized that individual features and sub-combinations of these features can be used to obtain some of the aforementioned advantages without the necessity to adopt all of these features.

In one construction, the bath shell can be formed using a vacuum forming process. The process includes the use of a double sided vacuum forming oven, which has the capability to heat the thicker sheets from both sides evenly to allow the sheet to heat efficiently without burning it. A top movable platen with a sealing frame and sealing gasket for secondary sheet sealing can be used. A timed process can be used to allow the top platen and sealing frame to engage the sheet and sealing gasket to provide a perimeter seal. This operation provides a vacuum for the heavier gauged acrylic into the bath mold. A bath tool can be provided with a desired draw ratio to assure a consistent shell thickness.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention. While specific bathtub configurations have been illustrated, the present invention is not limited to any of the aesthetic aspects shown and, in practice, may differ significantly from the illustrated configurations.

The invention claimed is:

1. A bathtub, comprising:

a shell for transmitting light thorough a thickness thereof; and a light emitting diode disposed under the shell, in which the light from the light emitting diode is transmitted thorough the thickness of the shell;

a light diffuser panel for diffusing light produced by the light emitting diode to be transmitted to the shell, and the light diffuser panel being disposed between the shell and the light emitting diode;

a support panel for transmitting light from the light emitting diode, and the support panel being disposed between the light diffuser panel and the light emitting diode; and a reflector surface for reflecting light from the light emitting diode; and wherein the light emitting diode is disposed between the reflector surface and the support panel.

2. The bathtub according to claim 1, further comprising a microprocessor for controlling operation of the light emitting diode.

3. The bathtub according to claim 1, further comprising a fluid control system for controlling the light emitting diode.

4. The bathtub according to claim 1, further comprising a support frame with a resilient member provided between the shell and the support frame.

5. The bathtub according to claim 4, wherein the shell includes a rim channel and the support frame includes a top tube configured to be received in the rim channel.

6. The bathtub according to claim 5, wherein the resilient member is disposed on the top tube.

7. The bathtub according to claim 1, wherein the support panel further comprises a plurality of support panels.

8. The bathtub according to claim 1, wherein the light emitting diode includes a plurality of the light emitting diodes.

9. The bathtub according to claim 1, wherein the shell comprises a translucent material.

10. The bathtub according to claim 1, further comprising a cover panel provided below the shell and surrounding the light emitting diode.

11. The bathtub according to claim 10, wherein the cover panel includes a leveling extension configured for leveling the shell.

12. The bathtub according to claim 11, further comprising a support frame for holding the shell and the support frame includes an shaft movable in the leveling extension of the cover panel.

13. The bathtub according to claim 1, further comprising a pressurized fluid control system for controlling the light emitting diode.

14. The bathtub according to claim 13, wherein the light emitting diode includes a plurality of light emitting diodes which produce different wavelengths of visible light responsive to the control system.

15. The bathtub according to claim 1, wherein the light emitting diode is provided in a generally parallel arrangement with respect to the reflector surface.

16. A bathtub comprising:

a shell;

a support for retaining the shell therein;

a plurality of light emitting diodes disposed underneath the shell; wherein the shell comprises a light transmissible material so that the light from light emitting diodes is transmitted via the shell;

a light diffuser panel disposed between the shell and the support, the diffuser panel being disposed above the light emitting diodes; and a cover panel being operably connected to the support for moving the shell and the diffuser panel in a direction generally perpendicular to a floor surface, and the cover panel including a reflective surface surrounding the light emitting diodes.

17. The bathtub according to claim 16, wherein the cover panel includes level adjuster extending therefrom and the support includes threaded device for receiving in the level adjuster.

18. The bathtub according to claim 16, further comprising a support panel disposed between the shell and the light emitting diode.

19. The bathtub according to claim 16, further comprising a pressurized fluid control system for controlling the light emitting diodes.

20. The bathtub according to claim 19, wherein the light emitting diode includes a plurality of light emitting diodes which produce different wavelengths of visible light responsive to the control system.

* * * * *